US010612248B2

(12) United States Patent
Hannig et al.

(10) Patent No.: US 10,612,248 B2
(45) Date of Patent: Apr. 7, 2020

(54) PANEL

(71) Applicant: AKZENTA PANEELE + PROFILE GMBH, Kaisersesch (DE)

(72) Inventors: Hans-Jürgen Hannig, Bergisch Gladbach (DE); Erich Schäfers, Demerath (DE)

(73) Assignee: AKZENTA PANEELE + PROFILE GMBH, Kaisersesch (DE)

( * ) Notice: Subject to any disclaimer, the term of this patent is extended or adjusted under 35 U.S.C. 154(b) by 0 days.

(21) Appl. No.: 15/746,605

(22) PCT Filed: Jul. 21, 2016

(86) PCT No.: PCT/EP2016/067443
§ 371 (c)(1),
(2) Date: Jan. 22, 2018

(87) PCT Pub. No.: WO2017/013221
PCT Pub. Date: Jan. 26, 2017

(65) Prior Publication Data

US 2018/0216353 A1 Aug. 2, 2018

(30) Foreign Application Priority Data

Jul. 22, 2015 (DE) ..... 10 2015 111 929

(51) Int. Cl.
*E04F 15/02* (2006.01)

(52) U.S. Cl.
CPC *E04F 15/02033* (2013.01); *E04F 2201/0107* (2013.01); *E04F 2201/026* (2013.01)

(58) Field of Classification Search
CPC ..... E04F 15/02033; E04F 2201/0107; E04F 2201/026
See application file for complete search history.

(56) References Cited

U.S. PATENT DOCUMENTS 444,042 A * 1/1891 Brock ..... E04F 13/10 52/578
1,776,188 A * 9/1930 Langbaum ..... A47B 1/00 52/592.4

(Continued)

FOREIGN PATENT DOCUMENTS

DE 20300306 U1 4/2003
DE 102006030852 A1 11/2007

(Continued)

OTHER PUBLICATIONS

English Translation of the Written Opinion for PCT/EP2016/067443 (6 pages), (dated 2017).*

*Primary Examiner* — Rodney Mintz
(74) *Attorney, Agent, or Firm* — Lucas & Mercanti, LLP; Klaus P. Stoffel

(57) ABSTRACT

A panel having a panel upper side and a panel lower side and at least two opposing panel edges. One panel edge has a simple fold projecting in the lower region of the panel edge and recessed in the upper region. The opposing panel edge has a complementary simple fold projecting in the upper region and recessed in the lower region, so that both folds form together a stepshaped connection in the connected state. The panel edges each have an edge break on the panel upper side, which form in the connected state a joint in a covering surface. The edge break of one of the panel edges is larger than the edge break of the opposing panel edge. A lower part of the large edge break of the one panel edge is overlapped in the connected state by the small edge break of the opposing panel edge.

6 Claims, 5 Drawing Sheets

(56) References Cited

U.S. PATENT DOCUMENTS 3,204,380 A * 9/1965 Wilson ..... E04B 1/8409 52/144
4,075,805 A * 2/1978 Bongiovanni ..... E04C 2/284 52/309.12
4,426,820 A * 1/1984 Terbrack ..... E01C 13/107 52/590.1
4,807,416 A * 2/1989 Parasin ..... E04F 15/04 52/573.1
8,176,698 B2 * 5/2012 Lewark ..... E04F 15/02 428/151
8,245,478 B2 * 8/2012 Bergelin ..... E04F 15/02 52/592.1
8,365,488 B2 * 2/2013 Chen ..... B41J 3/407 52/311.1
8,375,673 B2 * 2/2013 Evjen ..... E04F 15/04 52/588.1
8,720,150 B2 * 5/2014 Hannig ..... E04F 15/02038 52/590.2
9,315,994 B2 * 4/2016 Chen ..... B41J 3/407
9,347,227 B2 * 5/2016 Ramachandra ... E04F 15/02038
9,540,825 B2 * 1/2017 Ramachandra ..... E04F 15/105
9,828,777 B2 * 11/2017 Dohring ..... E04F 15/02183
10,329,776 B2 * 6/2019 Meersseman ..... E04F 15/02038
10,458,124 B2 * 10/2019 Loebel ..... E04F 15/02033
2002/0014047 A1 * 2/2002 Thiers ..... B44C 1/24 52/313
2002/0142135 A1 * 10/2002 Chen ..... B29C 65/56 428/143
2004/0035079 A1 * 2/2004 Evjen ..... E04F 15/04 52/592.1
2004/0128934 A1 * 7/2004 Hecht ..... E04F 15/02 52/578
2005/0166514 A1 * 8/2005 Pervan ..... B27F 5/026 52/578
2006/0179773 A1 * 8/2006 Pervan ..... B27N 7/00 52/592.1
2006/0260242 A1 * 11/2006 Boucke ..... E04F 15/02 52/506.1
2010/0018149 A1 * 1/2010 Thiers ..... E04F 15/02 52/588.1
2011/0114224 A1 * 5/2011 Fridlund ..... B27M 3/04 144/380
2011/0146188 A1 * 6/2011 Wallin ..... E04F 15/02033 52/588.1
2012/0247042 A1 * 10/2012 Clancy ..... E04B 1/6104 52/309.4
2013/0305650 A1 * 11/2013 Liu ..... E04F 15/02038 52/592.1
2015/0113908 A1 * 4/2015 Ramachandra ... E04F 15/02038 52/745.13
2015/0290968 A1 * 10/2015 Hannig ..... E04F 15/102 428/192
2017/0030088 A1 * 2/2017 Simoens ..... E04F 15/02038
2018/0094441 A1 * 4/2018 Boo ..... E04F 15/02033
2018/0266121 A1 * 9/2018 Meersseman ..... E04F 15/02038
2019/0003188 A1 * 1/2019 Loebel ..... E04F 15/02033

FOREIGN PATENT DOCUMENTS

DE 102011111166 A1 2/2013
DE 202014005148 U1 7/2014
FR 2063228 A5 7/1971
JP H07189466 A 7/1995
WO 2011114387 A1 9/2011
WO WO-2016113721 A1 * 7/2016 ..... E04F 15/02038

* cited by examiner

PANEL

The present application is a 371 of International application PCT/EP2016/067443, filed Jul. 21, 2016, which claims priority of DE 10 2015 111 929.3, filed Jul. 22, 2015, the priority of these applications is hereby claimed and these applications are incorporated herein by reference.

BACKGROUND OF THE INVENTION

The invention concerns a panel having a panel top side and a panel underside and at least two mutually opposite panel edges, of which one panel edge has a simple rabbet which projects in the lower region of the panel edge and is set back in the upper region and of which the opposite panel edge has a complementary simple rabbet which projects in the upper region of the panel edge and is set back in the lower region so that the two rabbets in the connected condition together form a stepped connection, wherein the panel edges at the panel top side respectively have an edge break which in turn in the connected condition together form a join in a floor surface.

Panels of that kind are used for example as floor panels. Panels of that general kind are generally secured together by adhesive at the panel edges and/or are adhesively secured to the substrate on which they are arranged. The mutually opposite panel edges of a panel are complementary to each other. In principle they can be joined together when the panel is cut. When laying panels it is usual for the last panel at the end of a row of panels to be shortened if required if the space is not sufficient to fit the entire panel.

Because panels of that kind have a simple rabbet they are rarely used for floatingly laid floors. Substrates for floor coverings often have irregularities to which a floor covering must adapt or compensate for same. In addition a floatingly laid floor can also involve the possibility that the floor covering which is assembled from panels virtually to form a sheet can expand or contract by virtue of temperature and moisture influences.

Floor panels which are not of the general kind set forth above frequently have panel edges which provide a positively locking action in order to be able to transmit holding forces from one floor panel into an adjacent panel connected thereto in a horizontal direction, and also to be able to transmit holding forces perpendicularly to the plane of the floor covering. In that way a floatingly laid floor covering sheet can expand and also generally contract again in respect of its area without gaps or heightwise displacement occurring between the panel edges of the individual floor panels.

SUMMARY OF THE INVENTION

The object of the invention is to provide a panel and in particular a floor panel having panel edges which have substantially a simple rabbet, which in the case of a glued connection permits a good connection between the panel edges but which is also suitable for floating laying.

According to the invention that object is attained in that the edge break of one of the panel edges is larger than the edge break of the opposite panel edge and that a lower part of the large edge break of the one panel edge in the connected condition is overlapped by the small edge break of the opposite panel edge.

The proposed measure affords an undercut configuration perpendicularly to the plane of the panels. In the connected condition of two panel edges or two panels, the undercut configuration limits a heightwise displacement and holds the complementary panel edges together in a perpendicular direction. If the panel edges are glued together as is usual even in the case of tongue and groove edges, the adhesive connection is supported by the overlapping of the large edge break. This involves a floating laying situation.

Alternatively the floatingly laid panel can lie on a non-slip underlay material or the panel can be provided at its underside itself with a non-slip coating, for example a rubber coating.

Finally gluing of the panel to the substrate is also possible. Preferably adhesive is applied to the panel underside but a peripherally free edge is left so that the adhesive can flow to the edge and to the underside join when the panel is pressed against the substrate. In that way adhesive passes at least a distance between the panel edges and can certainly pass between the butting surfaces and glue them together, whereby an additional adhesive bond is produced between the butting surfaces and the strength of that connection is improved.

It will be appreciated that panels according to the invention can also be used for wall coverings, ceiling coverings or coverings for surfaces of articles of furniture. They are suitable for example as an alternative or as a replacement for wall and floor tiles and in particular depending on the respective choice of material also for use in wet rooms.

The configuration of the new panel is particularly well suited for thin panels by virtue of the particular configuration with simple rabbets and overlapping edge breaks. This means a panel thickness which is less than 5 mm, preferably 4 mm or less and particularly preferably 2 mm or less.

Desirably the large edge break is arranged at that panel edge, the rabbet of which projects in the lower region. That structure has a particularly simple and clear design configuration. A somewhat more complex design is one in which the large edge break is provided at the other panel edge, that is to say at that panel edge whose rabbet projects in the upper region.

Preferably at least one of the edge breaks is in the form of a bevel. A bevel is simple from the point of view of manufacturing technology. In manufacture the inclination of the bevel with respect to the panel surface can be adjusted as desired.

In addition at least one of the edge breaks can be in the form of a rounded configuration. A round edge break is also simple to produce and affords creative design diversity. A rounded configuration which is provided at a panel edge can be combined with a bevel which is arranged at the opposite panel edge of the same panel.

That rabbet which projects in the lower region of the panel edge and/or the rabbet which projects in the upper region of the panel edge can be of such a configuration that in the connected condition it ends at a spacing in front of the set-back region of the complementary rabbet. In that case a respective gap is formed, when the complementary panel edges are connected together.

Alternatively that rabbet which projects in the lower region of the panel edge and/or the rabbet which projects in the upper region of the panel edge can butt in the connected condition against the set-back region of the complementary rabbet. The mutually butting surfaces serve as an abutment. In contact with each other they define the relative position of the panel edges relative to each other, which can be referred to as the target position.

An undercut contour having a lateral projection can be provided at one of the rabbets in the upper region near the panel top side, in which case the small edge break is at the lateral projection of that contour.

In addition it is useful if the lateral projection of the contour has a locking surface which is directed towards the panel underside. The locking surface cooperates with the overlapped region of the large edge break.

The cooperation can be such that a gap is provided between the locking surface of the lateral projection of the contour and the overlapped region of the large edge break when the panel edges are connected together.

In an alternative configuration the cooperation in contrast can be such that the locking surface of the lateral projection of the contour and the overlapped region of the large edge break are in contact with each other when the panel edges are connected together.

Instead of an adhesive join at the rabbets the panels can alternatively also only be glued to the substrate. The configuration of the rabbets nonetheless permits a connection which is protected from heightwise displacement because no rabbet can deflect unlimitedly upwardly.

The panels according to the invention preferably comprise a carrier or core of a solid material, for example a wood material, which is provided on at least one side with a decorative layer and a cover layer and optionally with further layers, for example a wearing layer disposed between the decorative layer and the cover layer.

In that respect, "wood materials" in accordance with the invention, besides solid wood materials, are also materials like for example cross-laminated board, laminated board, blockboard, veneered plywood, veneered laminated wood, veneered strip wood and bending plywood. In addition the term wood materials in accordance with the invention is also used to denote particle board like for example pressed chipboard, extruded chipboard, oriented structural board (OSB) and strip chipboard and also wood fiber materials like for example wood fiber insulating boards (HDF), medium-hard and hard fiber boards (MB, HFH) and in particular medium-density fiber boards (MDF) and high-density fiber boards (HDF). Modern wood materials like wood-polymer materials (wood plastic composite, WPC), sandwich boards comprising a light core material like foam, hard foam or paper honeycomb and a wood layer applied thereto, as well as chipboard bound with mineral, for example with cement, form wood materials in accordance with the invention. In that respect cork also represents a wood material in accordance with the invention.

In accordance with the invention the term "fiber materials" is used to denote materials like for example paper and non-woven materials on the basis of vegetable, animal, mineral and also synthetic fibers, as well as cardboards. Examples are fiber materials made from vegetable fibers and besides papers and non-woven materials of pulp fibers boards of biomass like straw, maize straw, bamboo, greenery, alga extract, hemp, cotton or oil palm fibers. Examples of animal fiber materials are for example keratin-based materials like for example wool or horsehair. Examples of mineral fiber materials are made of mineral wood or glass wool.

According to a configuration a carrier or a carrier board based on a plastic or a wood-plastic composite material (WPC) can be used for a panel according to the invention. For example the carrier board can be formed from a thermoplastic, elastomeric, or thermosetting plastic. Recycling materials from the specified materials can be used in the context of the panel according to the invention. In that respect preferred carrier board materials can be in particular thermoplastic materials like polyvinyl chloride, polyolefins (for example polyethylene (PE), polypropylene (PP), polyamides (PA), polyurethane (PU), polystyrene (PS), acrylonitrile-butadiene-styrene (ABS), polymethyl methacrylate (PWMA), polycarbonate (PC), polyethylene terephalate (PET), polyether etherketone (PEEK) or mixtures or copolymers thereof. In that respect independently of the base material of the carrier it is possible to provide for example plasticizers which can be present for example in a range of between >0% by weight and ≤20% by weight, in particular ≤10% by weight, preferably ≤7% by weight, for example in a range of between ≥5% by weight and ≤10% by weight. A suitable plasticizer includes for example the plasticizer marketed by BASF under the trade name "Dinsch". In addition copolymers like for example acrylates or methacrylates can be provided as a substitute for conventional plasticizers. In addition in this configuration the carrier can be cooled to a temperature below the melting temperature of the plastic component, in or before the two-belt press. In a preferred configuration of the invention the carrier board is substantially free of plasticizers, in which respect the expression "substantially free of plasticizers" in accordance with the invention is used to mean a plasticizer concentration <<1%.

In particular thermoplastic materials also afford the advantage that the products produced therefrom can be very easily recycled. It is also possible to use recycling materials from other sources. That affords a further possible option for reducing the manufacturing costs in the manufacture of panels according to the invention. In that respect such carriers are very elastic or springy, which allows a comfortable impression when walking thereon and in addition can reduce the noise occurring when walking thereon in comparison with conventional materials so that it is possible to achieve an improved footstep sound.

In addition the above-mentioned carriers afford the advantage of good water resistance as they involve a swelling of 1% or less. Besides pure plastic carriers, that surprisingly also applies to WPC materials, as are described in detail hereinafter.

In a particularly advantageous fashion the carrier material can have or consist of wood-polymer materials (wood plastic composite, WPC). Here for example a wood and a polymer can be suitable, which can be present in a ratio of between 40/60 and 70/30, for example 50/50. For example polypropylene, polyethylene or a copolymer of the two afore-mentioned materials can be used as the polymer components, while in addition wood powder can be used as the wood component. In addition the above-described carrier boards based on such WPC materials exhibit good water compatibility with a degree of swelling of less than 1%. In that respect WPC materials have for example stabilizers and/or other additives which can preferably occur in the plastic component.

In addition it can be particularly advantageous for the carrier material to include or consist of a PVC-based material. Such materials can also serve in a particularly advantageous fashion for high-quality panels which can be used without any problem for example even in wet rooms. Furthermore PVC-based carrier materials also present themselves for a particularly effective manufacturing process as here for example line speeds of 8 m/min (26.25 ft/min) with a product thickness for example of 4.1 mm (0.1614 in.) can be possible, which can permit a particularly effective manufacturing process. Furthermore such carriers also enjoy advantageous elasticity and water compatibility, which can lead to the above-mentioned advantages.

In relation to plastic-based panels and also in relation to WPC-based panels, for example based on polypropylene, mineral fillers can be of advantage in that respect. Here for example talcum or talc or also calcium carbonate (chalk), aluminum oxides, silica gel, quartz flour, wood powder and gypsum are particularly suitable. For example it is possible to use chalk.

The proportion of the mineral fillers can be in a range of between ≥30% by weight and ≤80% by weight, for example between ≥45% by weight and ≤70% by weight. Slippage of the carrier can be improved by the fillers, in particular the chalk. When using talcum, for example, it may then be possible to achieve improved heat resistance and humidity resistance. The fillers can also be colored in known fashion. For example there may be a mixture of talcum and polypropylene in which talcum is present in the above-mentioned quantitative range, for example at about 60% by weight. In particular it can be provided that the plate material has a flame-proofing agent.

In a particularly preferred configuration of the invention the carrier material comprises a mixture of a PE/PP block copolymer with wood. In that respect the proportion of the PE/PP block copolymer and the proportion of the wood can be between ≥45% by weight and ≤55% by weight. Furthermore the carrier material can have between ≥0% by weight and ≤10% by weight of further additives like for example flow aids, thermostabilizers or UV-stabilizers. The particle size of the wood in that case is between >0 μm and ≤600 μm with a preferred particle size distribution D50 of ≥400 μm. In particular in that case the carrier material can have wood with a particle size distribution D10 of ≥400 μm. The particle size distribution in that respect is related to the volumetric diameter and relates to the volume of the particles.

In a further preferred configuration of the invention the carrier material comprises a mixture of a PE/PP polymer blend with wood. In that case the proportion of PE/PP polymer blend and the proportion of the wood can be between ≥45% by weight and ≤55% by weight. Furthermore the carrier material can have between ≥0% by weight and ≤10% by weight of further additives like for example flow aids, thermostabilizers or UV-stabilizers. The particle size of the wood in that case is between ≥0 μm and ≤600 μm with a preferred particle size distribution D50 of ≥400 μm. In particular in that case the carrier material can have wood with a particle size distribution D10 of ≥400 μm. The particles size distribution in that respect is related to the volumetric diameter and relates to the volume of the particles. Particularly preferably in that respect the carrier material is prepared in the form of a granulated or pelleted pre-extruded mixture from a PE/PP polymer blend with wood particles of the specified particle size distribution.

In a further configuration of the invention the carrier material comprises a mixture of a PP homopolymer with wood. In that case the proportion of the PP homopolymer and the wood proportion can be between ≥45% by weight and ≤55% by weight. For example the components wood and polypropylene can be present in a ratio of between 0.5:1 and 1:0.5, for example 1:1. In addition the carrier material can have between ≥0% by weight and ≤10% by weight of further additives like for example flow aids, thermostabilizers or UV-stabilizers. The particle size of the wood in that case is between >0 μm and ≤600 μm with a preferred particle size distribution D50 of ≥400 μm. In particular in that respect the carrier material can have wood of a particle size distribution D10 of ≥400 μm. The particle size distribution is related in that case to the volumetric diameter and relates to the volume of the particles. Particularly preferably the carrier material is prepared in the form of granulated or pelleted pre-extruded mixture consisting of a PP homopolymer with wood particles of the specified particle size distribution.

The granular material and/or the pellets can preferably be for example of a grain size in a range of between ≥400 μm and ≤10 mm (0.3937 in.), preferably between ≥600 μm and ≤10 mm (0.3937 in.), in particular between ≥800 μm and ≤10 mm (0.3937 in.). In a further configuration of the invention the carrier material comprises a mixture of a PVC polymer with chalk. In that case the proportion of the PVC polymer and the chalk proportion can be between ≥45% by weight and ≤55% by weight. Furthermore the carrier material can have between ≥0% by weight and ≤10% by weight of further additives like for example flow aids, thermostabilizers or UV-stabilizers. The particle size of the chalk in that case is between >0 μm and ≤1000 μm, for example between ≥800 μm and ≤1000 μm, with a preferred particle size distribution. D50 of ≥400 μm, for example ≥600 μm. In particular the carrier material can in that case involve chalk with a particle size distribution D10 of ≥400 μm, for example ≥600 μm. The particle size distribution is related in that case to the volumetric diameter and relates to the volume of the particles. Particularly preferably in that case the carrier material is prepared in the form of granulated or pelleted pre-extruded mixture consisting of a PVC polymer with chalk of the specified particle size distribution. The granular material and/or the pellets can in that case preferably be for example of a grain size in a range of between ≥400 μm and ≤10 mm (0.3937 in.), preferably ≥600 μm and ≤10 mm (0.3937 in.), in particular between ≥800 μm and ≤10 mm (0.3937 in.), for example ≥1000 μm and ≤10 mm (0.3937 in.).

In a further configuration of the invention the carrier material comprises a mixture of a PVC polymer with wood. The proportion of the PVC polymer and the wood proportion can be between ≥45% by weight and ≤55% by weight. Furthermore the carrier material can have between ≥0% by weight and ≤10% by weight of further additives like for example flow aids, thermostabilizers or UV-stabilizers. The particle size of the wood in that case is between >0 μm and ≤1000 μm, for example between ≥800 μm and ≤1000 μm, with a preferred particle size distribution D50 of ≥400 μm, for example ≥600 μm. In particular the carrier material can have wood of a particle size distribution D10 of ≥400 μm, for example ≥600 μm. The particle distribution in that case is related to the volumetric diameter and relates to the volume of the particles.

Particularly preferably in that case the carrier material is prepared in the form of a granulated or pelleted pre-extruded mixture comprising a PVC polymer with wood particles of the specified particle size distribution.

For determining the particle size distribution, it is possible to have recourse to the generally known methods like for example laser diffractometry, with which it is possible to determine particles sizes in the range of between some nanometers to several millimeters. By means of that method it is also possible to determine D50 and D10 values in respect of which 50% and 10% respectively of the measured particles are smaller than the specified value.

In accordance with a further configuration the carrier material can have hollow microspheres. Such additives can provide in particular that the density of the carrier and thus the panel produced therefrom can be significantly reduced so that it is possible to ensure particularly simple and inexpensive transport and also particularly comfortable laying. In that case stability of the panel produced can be guaranteed in particular by the inclusion of hollow microspheres, the stability not being significantly reduced in comparison with a material without hollow microspheres. Thus the stability for a large part of applications is totally adequate. In this respect the term hollow microspheres can denote in particular structures which have a hollow main body and are of a size and a maximum diameter which is in the micrometer range. For example hollow spheres which can be used can be of a diameter which is in the range of between ≥5 μm and ≤100 μm, for example between ≥20 μm and ≤50 μm. In principle any material can be considered as the material of the hollow microspheres, like for example glass or ceramic. In addition by virtue of the weight plastic materials, for example the plastics which are also used in the carrier material, for example PVC, PE or PP, can be advantageous, in which case, for example by virtue of suitable additives, they can possibly be prevented from deformation during the manufacturing procedure. In accordance with a further configuration a fiber material can be incorporated into the carrier. For example a glass fiber non-woven material can be used in the carrier material in this configuration. In this configuration, a carrier can be produced with a particularly high level of load-carrying capacity or stability as the strength of the carrier can be significantly increased by the incorporated fiber material. In addition in this configuration the carrier can be particularly cut to size as for example the provision of a plurality of spreading units, as is described in detail hereinbefore, means that the carrier material can be adjusted as desired for example above and below the non-woven material. In addition a structure which can still be cut to size can be enabled by the provision of a plurality of fiber material webs, wherein the carrier material can in turn be adapted as desired or varied.

Irrespective of the exact configuration of the panel but in particular in dependence on the locking shape it can be of a thickness in a range of for example between ≥1.5 mm (0.059 in.) and ≤5.0 mm (0.1968 in.), preferably between ≥1.5 mm (0.059 in.) and ≤3.5 mm (0.1378 in.) and particularly preferably between ≥2 mm (0.0787 in.) and ≥2.8 mm (0.1102 in.).

BRIEF DESCRIPTION OF THE DRAWING

The invention is illustrated by way of example in a drawing and described in detail by means of a number of embodiments by way of example. In the drawing.

DETAILED DESCRIPTION OF THE INVENTION

Figure 1:
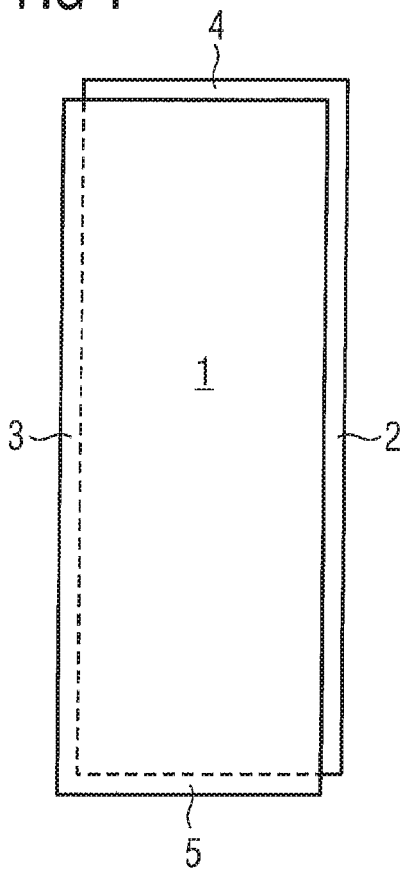
FIG. 1 shows a diagrammatic plan view of a panel according to the invention of rectangular shape.

The example shown in FIG. 1 involves a panel 1 of a rectangular base surface. The panel has two pairs of edges, whose panel edges 2, 3 and 4, 5 respectively are respectively disposed in paired opposite relationship. The panel edges are provided with complementary simple rabbets according to the invention.

Figure 2:
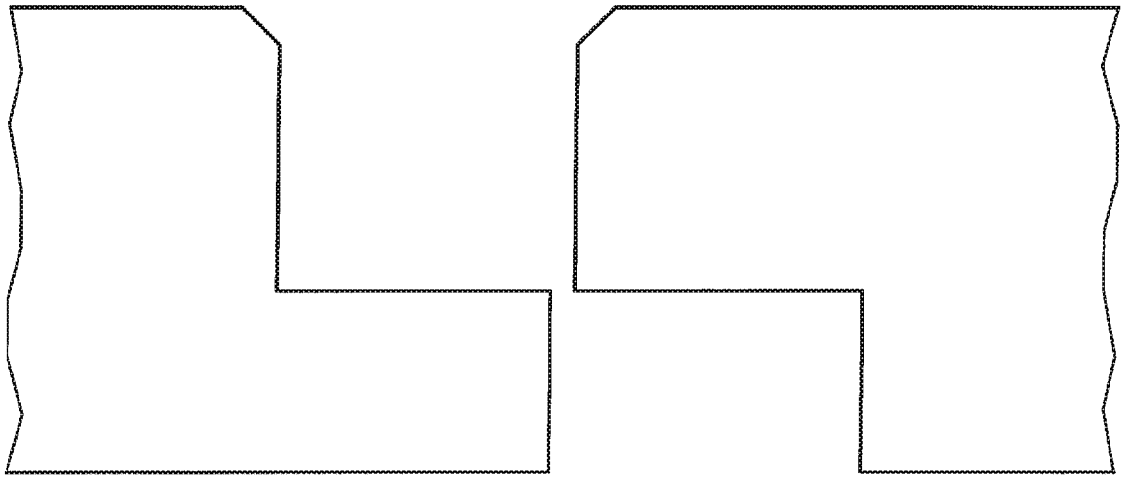
FIG 2 PRIOR ART
FIG. 2 shows mutually opposite panel edges of a panel according to the state of the art in the connected condition.

FIG. 2 shows complementary panel edges of a panel according to the state of the art. The panel edges are shown in the connected condition.

Figure 3:
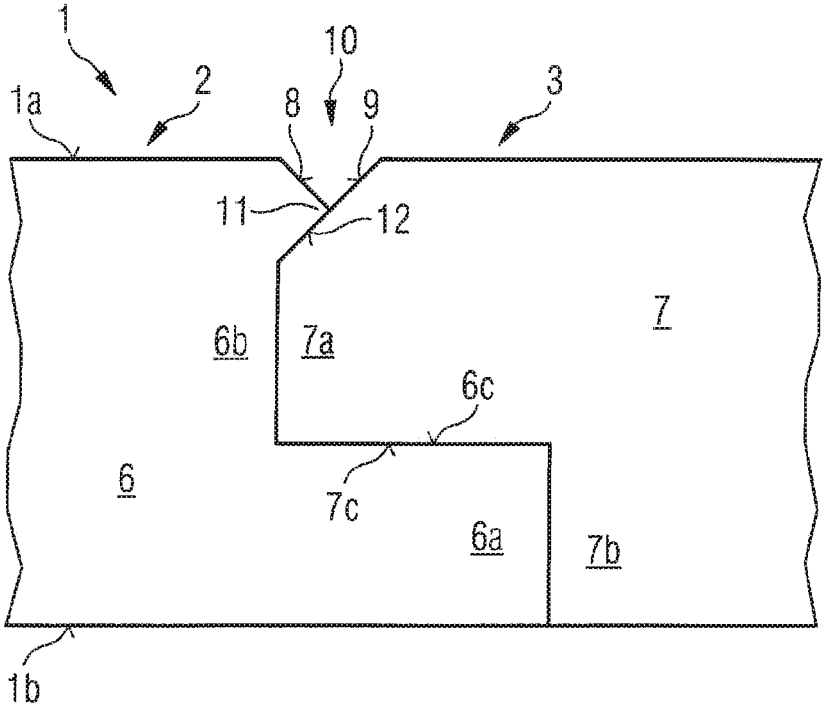
FIG. 3 shows mutually opposite panel edges of a panel according to the invention in the connected condition.

FIG. 3 shows the panel edges 2 and 3 of a panel 1 according to the invention, also in the connected condition. The panel has a panel top side 1*a* and a panel underside 1*b*. The panel edge 2 has a simple rabbet 6 which projects in the lower region 6*a* of the panel edge and is set back in the upper region 6*b*. The oppositely disposed panel edge 3 has a simple rabbet 7 which is complementary thereto and which projects in the upper region 7*a* of the panel edge and is set back in the lower region 7*b*. A contact surface 6*c* of the rabbet extends between the lower region 6*a* and the upper region 6*b* and a contact surface 7*c* extends between the upper region 7*a* and the lower region 7*b*. The contact surfaces are parallel to the panel top side. In the connected condition shown here the two rabbets 6 and 7 together form a stepped connection.

At the panel top side 1*a* the panel edge 2 has a small edge break 8 while the panel edge 3 at the panel top side has a large edge break 9. The edge breaks 8 and 9 in turn in the connected condition together form a join 10 in the covering surface. The large edge break 9 extends under the small edge break 8. The large edge break 9 is partly overlapped by the small edge break 8. The two edge breaks 8 and 9 are in the form of a 45° bevel.

The small edge break 8 is arranged at a contour which is of an undercut configuration as viewed from the panel top side. In the upper region of the rabbet 6, at its set-back region 6*b*, near the panel top side 1*a*, that contour forms a lateral projection 11. The lateral projection has a locking surface 12 which is directed towards the panel underside 1*b*. In FIG. 3 the overlapped region of the large edge break (45° bevel) bears against the locking surface 12 of the projection 11. In addition the rabbet 6 and the rabbet 7 are in contact over the entire cross-section with the exception of the region of the join 10.

Figure 4:
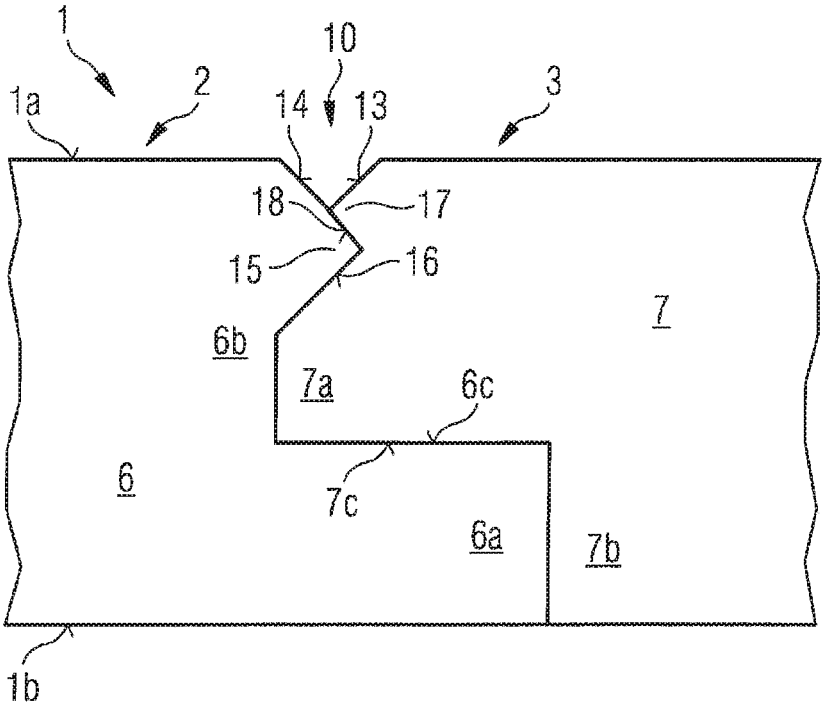
FIG. 4 shows mutually opposite panel edges of an alternative embodiment of a panel according to the invention in the connected condition.

FIG. 4 shows an alternative configuration of a panel according to the invention and also shows the panel edges thereof in the connected condition. The panel 1 also has a simple rabbet 6 with a lower region 6*a* which projects and an upper region which is set back as well as a simple rabbet 7 with an upper projecting region 7*a* and a lower set-back region 7*b*. As a distinction in relation to the previous embodiment the edge breaks are interchanged, that is to say a small edge break 13 is arranged on the rabbet 7, more specifically at its projecting upper region 7*a*, and a small edge break 14 is provided at the set-back upper region 6*b* of the rabbet 6.

The upper region 6*b* of the rabbet 6, near the panel top side 1*a*, has a lateral projection 15 which is directed towards the panel top side. The projection is here provided with the large edge break 13. The projection 15 has a locking surface 16, directed towards the panel underside 1*b*.

Near the panel top side 1*a* the upper region 7*a* of the rabbet 7 has a lateral projection 17 directed towards the panel top side. That projection is provided with the small edge break 13 and it also has a locking surface 18 directed towards the panel underside 1*b*. That locking surface 18 overlaps a part of the large edge break 14 of the rabbet 6. Provided in the upper projecting region 7*a* of the rabbet 7 is a jagged contour 19 which includes a wedge-shaped groove 20, thereby forming an undercut configuration. In addition the rabbet 6 in the upper region also includes a groove 21, thereby forming a further undercut configuration so that this embodiment is as it were doubly of an undercut configuration. The rabbet 6 and the rabbet 7 are in contact over the entire cross-section with the exception of the region of the join 10.

Figure 5:
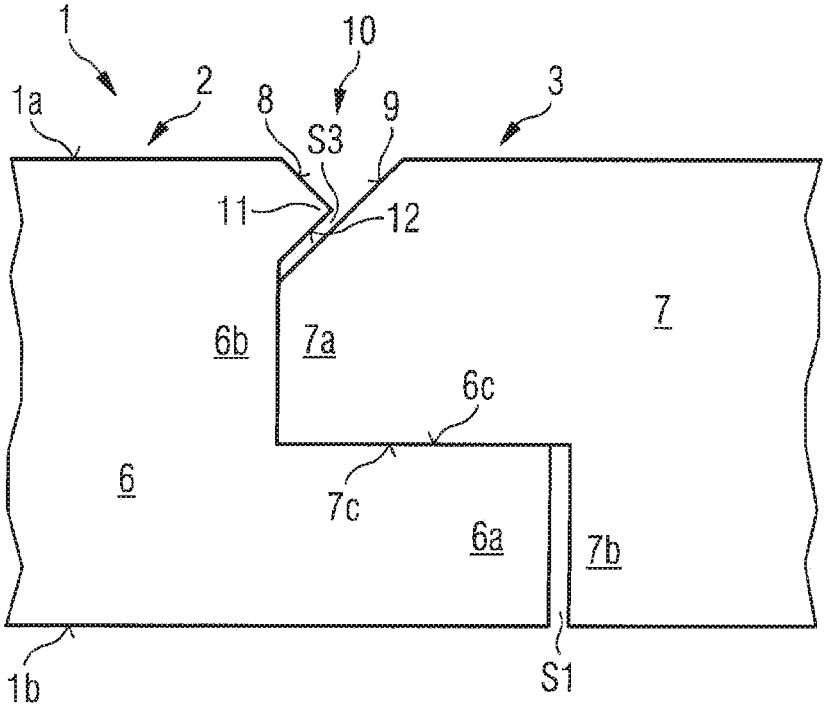
FIG. 5 shows a development of the panel edges of FIG. 3.

The embodiment of FIG. 5 is based on that shown in FIG. 3. Here once again a projection 11 having a locking surface 12 is provided upwardly on the rabbet 6. As a distinction in relation to FIG. 3 the overlapped part of the large edge break 9 of the rabbet 7 does not extend as far as the locking surface 12 of the rabbet 6, instead there is a gap. The projecting upper region 7*a* of the rabbet 7 however is in contact with the upper set-back region 6*b* of the rabbet 6. The set-back lower region 7*b* of the rabbet 7 is however at a spacing relative to the lower projecting region 6*a* of the rabbet 6. The contact surfaces 6*c* and 7*c* are in contact with each other.

Figure 6:
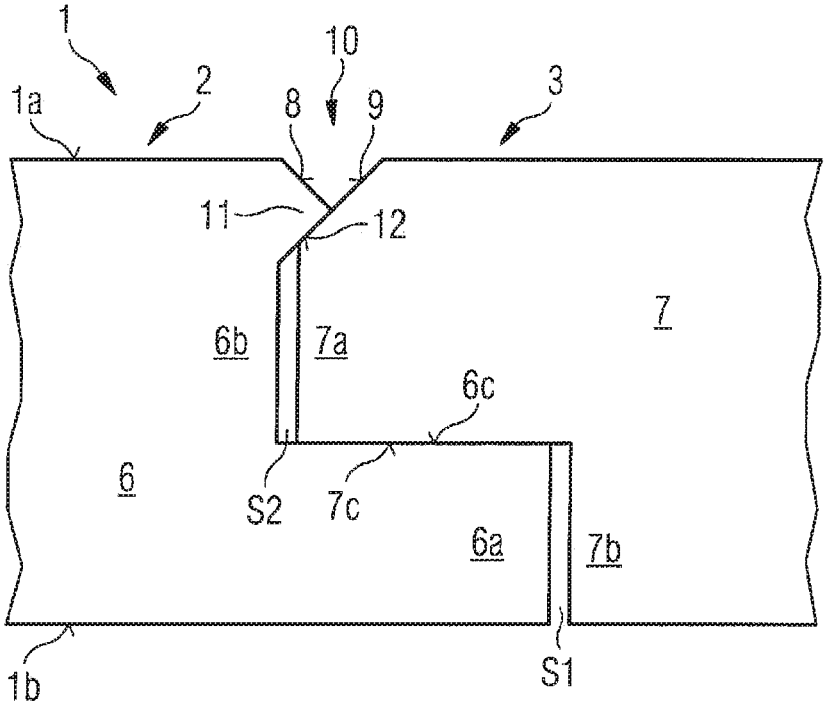
FIG. 6 shows an alternative development of the panel edges of FIG. 3.

The embodiment of FIG. 6 is also based on that shown in FIG. 3 and in turn a projection 11 having a locking surface 12 is provided upwardly on the rabbet 6. Here the overlapped part of the large edge break 9 of the rabbet 7 bears against the locking surface 12 of the rabbet 6. In addition the contact surfaces 6*c* and 7*c* are in contact with each other. The projecting upper region 7*a* of the rabbet 7 is however not in contact with the upper set-back region 6*b* of the rabbet 6. The set-back lower region 7*b* of the rabbet 7 is also not in contact with the lower projecting region 6*a* of the rabbet 6.

A variant in which there is a gap in the upper region 7*a*/6*b* of the rabbets and the lower regions 6*a*/7*b* are in contact with each other is also possible (this is not shown).

Figure 7:
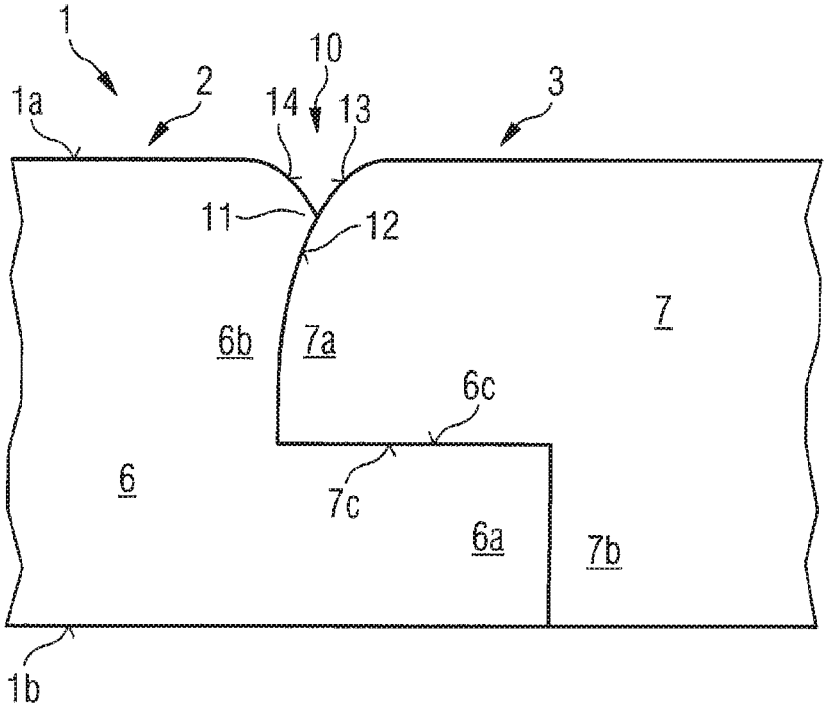
FIG. 7 shows mutually opposite panel edges of an alternative embodiment of a panel according to the invention in the connected condition.

FIG. 7 shows an alternative configuration of a panel according to the invention which is also based on the embodiment of FIG. 3. It differs therefrom only in that the edge breaks 8 and 9 are not bevels but rounded portions. In the present embodiment they are circular arcuate portions. The small edge break 8 is formed from a shorter arcuate portion and the edge break 9 is formed from a longer arcuate portion. The small edge break 8 is arranged at a projection upwardly on the set-back region 6*b* of the rabbet 6. A locking surface 12 of the projection 11 is also of an arcuate configuration, with the arcuate portion of the locking surface being matched to the circular arc of the overlapped part of the large edge break 9 of the rabbet 7. The rabbet 6 and the rabbet 7 are in contact over the entire cross-section with the exception of the join 10.

Figure 8:
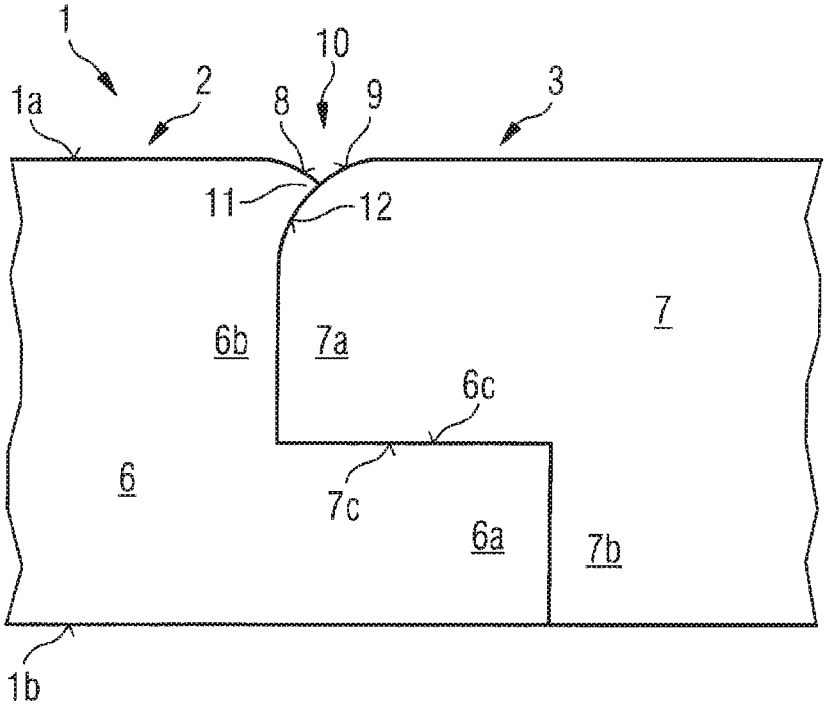
FIG. 8 shows mutually opposite panel edges of a further embodiment of a panel according to the invention in the connected condition.

The embodiment of FIG. 8 differs from FIG. 7 by virtue of different rounded configurations of the edge breaks 8 and 9. The large edge break 9 is of a quarter-circular cross-section. The small edge break 8 is of the same radius as the quarter-circle cross-section, but is shorter.

A locking surface 12 of the projection 11 is again of an arcuate configuration and has a matching radius which is adapted to the radius of the overlapped part of the large edge break 9 of the rabbet 7. The rabbet 6 and the rabbet 7 are in contact over the entire cross-section with the exception of the region of the join 10.

Figure 9:
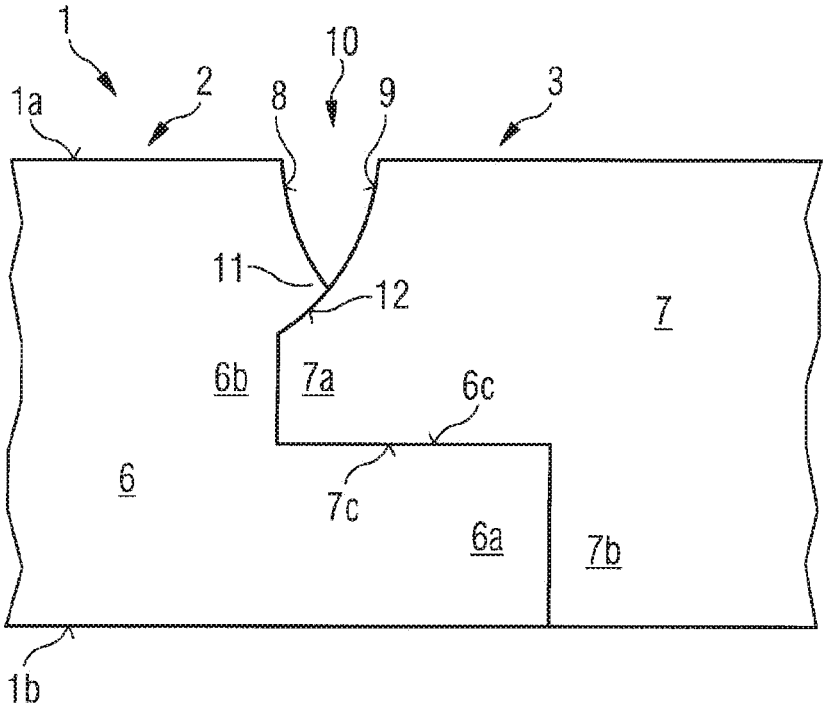
FIG. 9 shows mutually opposite panel edges of another embodiment of a panel according to the invention in the connected condition.

FIG. 9 shows an embodiment for edge breaks in the form of rounded portions which however have their center point outside the panel cross-section. The rounded portions are of a configuration in the manner of a hollow fillet. Together they form a V-shaped join 10, wherein the V-limbs are curved outwardly. In this embodiment also a projection 11 having a locking surface 12 directed towards the panel underside is provided upwardly on the rabbet 6 and in turn the locking surface is of an arcuate configuration and its radius is adapted to the radius of the overlapped part of the large edge break 9 of the rabbet 7. The rabbet 6 and the rabbet 7 are in contact over the entire cross-section with the exception of the region of the join 10.

Figure 10:
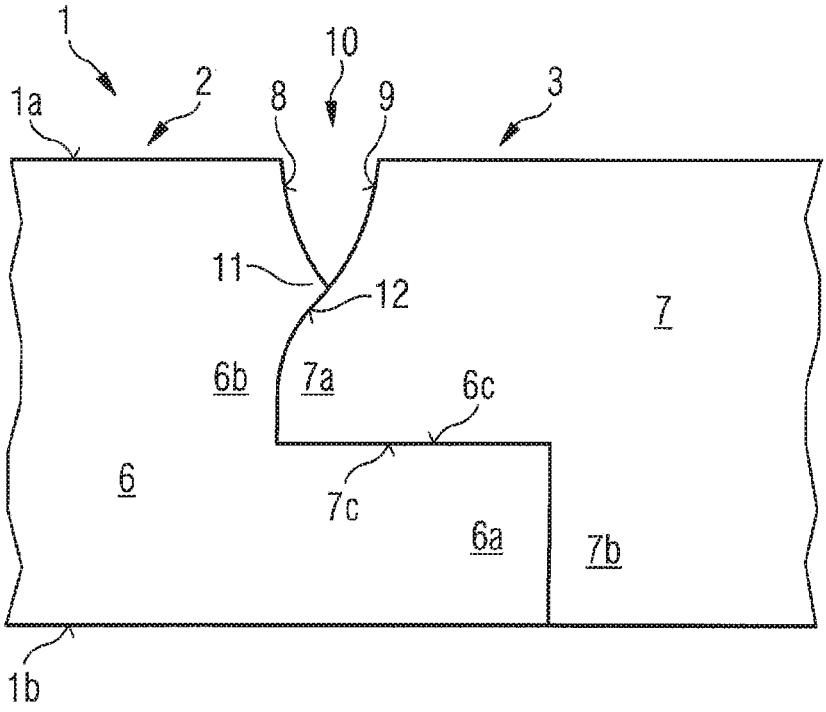
FIG. 10 shows mutually opposite panel edges of an additional embodiment of a panel according to the invention in the connected condition.

The embodiment of FIG. 10 is based on that shown in FIG. 9. It includes the hollow fillet-shaped small edge break 8 in an identical configuration. The large edge break 9 is also in the form of a hollow fillet in the region which is not overlapped and forms the one side of the join. In the overlapped region however the rounded configuration is not hollow fillet-shaped but is turned outwardly.

Reference was made to FIGS. 5 and 6 to describe embodiments with 45° bevel variants, which can have a gap at various locations of the connection and have mutually butting surfaces at other locations. It will be appreciated that the embodiment of FIG. 4 or the embodiments of FIGS. 7 through 10 can also be modified in such a way that, in front of the upper projecting region of the rabbet 7 and/or the lower projecting region of the rabbet 6, there is a gap when the panel edges are connected together. Equally there can then be a gap over the overlapped part of the large edge break.

LIST OF REFERENCES

1 panel
1*a* panel top side
1*b* panel underside
2 panel edge
3 panel edge
4 panel edge
5 panel edge
6 simple rabbet
6*a* lower region
6*b* upper region
6*c* contact surface
7 simple rabbet
7*a* upper region
7*b* lower region
7*c* contact surface
8 small edge break
9 large edge break
10 join
11 lateral projection
12 locking surface
13 small edge break
14 large edge break
15 lateral projection
16 locking surface
17 lateral projection
18 locking surface
19 jagged contour
20 wedge-shaped groove
21 groove
S1 gap
S2 gap
S3 gap

The invention claimed is:

1. A panel, comprising: a panel top side; a panel underside; and at least two mutually opposite panel edges, of which one panel edge has a simple rabbet that projects in a lower region of the panel edge and is set back in an upper region and of which an opposite panel edge has a complementary simple rabbet that projects in an upper region of the panel edge and is set back in a lower region so that the two rabbets in a connected condition together form a stepped connection, wherein the panel edges at the panel top side respectively have an edge break which in turn in the connected condition together form a joint in a covering surface, wherein the edge break of one of the panel edges is larger than the edge break of the opposite panel edge and a lower part of the large edge break of the one panel edge in the connected condition is overlapped by the small edge break of the opposite panel edge, wherein at least one of: A) the rabbet that projects in the lower region of the panel edge and B) the rabbet that projects in the upper region of the panel edge in the connected condition bears against a set-back region of the complementary rabbet, wherein the rabbets each have a surface, at least one of A) in the lower region and B) the upper region, that forms an abutment, the surface forming the abutment being substantially perpendicular to the panel top side, wherein one of the rabbets has the upper region near the panel top side an undercut contour having a lateral projection and the small edge break is disposed at the lateral projection of said undercut contour, wherein the lateral projection of the contour has a locking surface directed towards the panel underside, and wherein a gap is provided between the locking surface of the lateral projection of the contour and an overlapped region of the large edge break when the panel edges are connected together.

2. The panel according to claim 1, wherein the locking surface of the lateral projection of the contour and an overlapped region of the large edge break are in contact with each other when the panel edges are connected together.

3. The panel according to claim 1, wherein the large edge break is arranged at the panel edge whose rabbet projects in the lower region.

4. The panel according to claim 1, wherein at least one of the edge breaks is formed as a bevel.

5. The panel according to claim 1, wherein at least one of the edge breaks is formed as a rounded portion.

6. The panel according to claim 1, wherein the rabbet that projects in the lower region of the panel edge or the rabbet that projects in the upper region of the panel edge in the connected condition ends at a spacing in front of a set-hack region of the complementary rabbet so that a gap is formed.

* * * * *